US005792511A

United States Patent [19]

Oliver et al.

[11] Patent Number: 5,792,511

[45] Date of Patent: Aug. 11, 1998

[54] GRID AND METHOD FOR PRODUCING A PATTERN ON A SURFACE

[75] Inventors: Gerry Bill Oliver; Bruce Lorning Burton, both of Kelowna, Canada

[73] Assignee: IPC Techniques Inc., White Rock, Canada

[21] Appl. No.: 605,511

[22] Filed: Feb. 26, 1996

Related U.S. Application Data

[63] Continuation-in-part of Ser. No. 237,153, May 3, 1994, Pat. No. 5,494,372.

[51] Int. Cl.[6] ..... B05D 5/10

[52] U.S. Cl. ..... 427/136; 404/76; 427/271; 427/272; 427/282

[58] Field of Search ..... 404/72, 89; 427/136, 427/138, 271, 272, 282

[56] References Cited

U.S. PATENT DOCUMENTS

| | | | |
|---|---|---|---|
| 278,238 | 5/1883 | Harding . | |
| 333,459 | 12/1885 | Gibson . | |
| 2,056,274 | 10/1936 | Holdsworth | 91/16 |
| 2,365,705 | 12/1944 | Jeri | 117/6 |
| 3,096,195 | 7/1963 | Seman et al. | 117/8.5 |
| 3,692,458 | 9/1972 | Kirsch | 425/469 |
| 4,131,406 | 12/1978 | Fresquez | 425/385 |
| 4,239,820 | 12/1980 | Salvador | 427/282 |
| 4,379,187 | 4/1983 | Seman | 427/282 |
| 4,510,729 | 4/1985 | Syring | 52/741 |
| 5,038,714 | 8/1991 | Dye et al. | 118/504 |
| 5,173,337 | 12/1992 | Nelson | 427/282 |
| 5,186,983 | 2/1993 | Brown | 427/261 |
| 5,215,402 | 6/1993 | Stowell et al. | 404/93 |
| 5,263,294 | 11/1993 | Koenig et al. | 52/468 |
| 5,393,559 | 2/1995 | Shoesmith et al. | 427/136 |
| 5,494,372 | 2/1996 | Oliver et al. | 404/72 |

FOREIGN PATENT DOCUMENTS

| | | | |
|---|---|---|---|
| 0 160 315 A3 | 11/1985 | Japan . | |
| 348230 | 5/1931 | United Kingdom | 427/282 |
| 896135 | 5/1962 | United Kingdom | 427/282 |
| 0 589 673 A2 | 3/1994 | United Kingdom . | |

*Primary Examiner*—Michael Lusignan
*Attorney, Agent, or Firm*—Oyen Wiggs Green & Mutala

[57] ABSTRACT

A grid for producing a pattern on a surface. The grid includes elongated members connected together at intersections and extending about a plurality of open areas to form a mesh-like structure. Connecting members are connected to the elongated members at the intersections. The connecting members extend outwardly from at least one said elongated member. The connecting members have a thickness less than the thickness of the elongated members. The bottoms of the connecting members and bottoms of the elongated members are flush. The grid is placed on a surface and a liquid coating is spread over the surface in the open areas between the elongated members. The liquid coating is allowed to set. Preferably there is a removable coating on the grid which is removed after the liquid coating is set.

25 Claims, 7 Drawing Sheets

GRID AND METHOD FOR PRODUCING A PATTERN ON A SURFACE

This is a continuation-in-part of application Ser. No. 08/237,153 filed May 3, 1994, now U.S. Pat. No. 5,494,372.

BACKGROUND OF THE INVENTION

This invention relates to an apparatus and method for imprinting a surface with a design similar to bricks or stones and mortar.

Various apparatuses and methods have been devised to simulate the appearance of bricks and mortar or stones and mortar on horizontal or vertical surfaces such as drive-ways, floors or walls. Typically a paint or concrete mixture is applied in a thin coat on the surface with contrasting colors used for the bricks or stones and the mortar. The method commonly used is to apply a coating having the desired color of the mortar on the surface. Masking tape is then placed over this coating in a grid-like pattern to simulate the mortar. A second coating is then applied over the surface in the desired color of brick or stone. Finally the masking tape is removed, leaving lines of "mortar" between the "bricks" or "stones". However this method is labour intensive because of the considerable amount of work in laying out the pattern of masking tape and the requirement to apply two separate coatings to the surface.

Various products and methods have been developed in the past to simulate the appearance of brick or stone on other surfaces. One example is U.S. Pat. No. 4,379,187 to Seman. This discloses a method of simulating mortar lines on a brick wall using a preformed, grid-like structure. The grid is removed after the brick-like material is applied. U.S. Pat. No. 4,239,820 discloses a method of creating a simulated stone surface or the like. A pattern is partially die cut and has an adhesive on one side. U.S. Pat. No. 5,186,983 to Brown shows a process for decorating a hard surface. A template with holes is used. However, the "mortar" is first applied by means of colored paint.

The art described above has one thing in common. All of the art relies on removing a peelable layer along the lines of "mortar" to expose a layer having a distinct color and appearance compared to the "brick". This generally requires the application of two separate coatings to the surface thus increasing the amount of work and time involved. Furthermore, the appearance of the "mortar" is not always true to life because the effect is limited to the preexisting surface or coating exposed when a peelable layer is removed.

SUMMARY OF THE INVENTION

It is therefore an object of the invention to provide an improved apparatus and method for producing a brick and mortar or stone and mortar appearance on a surface which is less labour intensive and time consuming compared to prior art methods and apparatuses.

It is also an object of the invention to provide an improved apparatus and method of this type which requires the application of only a single liquid coating to the surface.

It is a further object of the invention to provide an improved apparatus and method of this type which provides a more convincing brick and mortar or stone and mortar appearance on the surface.

It is still a further object of the invention to provide an improved apparatus and method of this type which produces a simulated brick and mortar or stone and mortar surface which is durable and long lasting.

In accordance with these objects, there is provided a grid for producing a pattern on a surface. The grid includes elongated members connected together at intersections and extending about a plurality of open area to form a mesh-like structure. Each elongated member has a top, a bottom and a thickness extending between the top and the bottom.

Connecting members may be provided which are connected to the elongated members at the intersections. Each of the connecting members extends outwardly from at least one elongated member. Each connecting member has a top, a bottom and a thickness less than the thickness of said one elongated member. The bottoms of the connecting members and the elongated members are flush with each other.

According to another aspect of the invention, there is provided a method for producing a grid-like pattern on a surface. The method includes placing on the surface a grid which includes a plurality of elongated members connected together at intersections and extending about a plurality of open areas. The grid has a top with a removable layer thereon. A liquid coating is spread over the surface in the open areas between the elongated members of the grid. The liquid coating is allowed to set. The removable layer is then removed from the grid, exposing the elongated members.

Compared to prior art apparatuses and methods, the invention provides significant advantages. The appearance of mortar is achieved by applying a grid which is left in place instead of being removed as in the prior art. Thus the surface of the mortar can have a more convincing shape and texture than can be achieved simply by exposing the preexisting surface or an earlier applied liquid coating. Furthermore, the time to do the job can be appreciably reduced since only a single liquid coating is necessary (although a sealing coat may be applied if desired).

DESCRIPTION OF THE PREFERRED EMBODIMENTS

Figure 1:
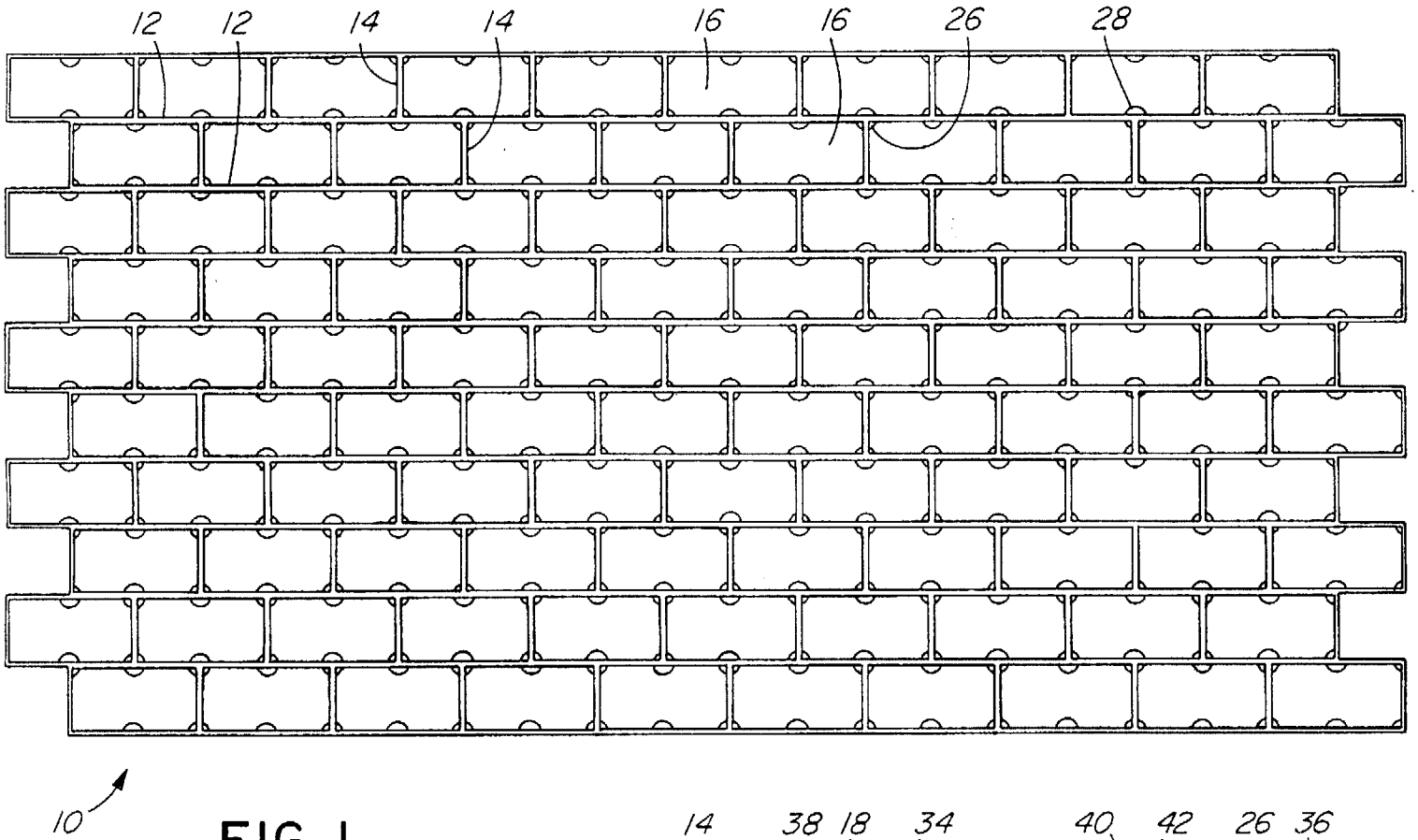
FIG. 1 is a top plan of a grid for producing a pattern on a surface according to an embodiment of the invention.

FIG. 1 shows a grid 10 for producing a pattern on a surface. The grid includes a plurality of first elongated members 12 which extend in parallel relationship along the length of the grid. The first members 12 are interconnected by a plurality of second members 14 which are parallel to each other and extend perpendicularly between adjacent members 12. The members 14 are staggered so that open areas 16 between the members 12 and 14 are rectangular and form a brick-like pattern with the members 12 and 14 mimicking lines of mortar between. It should be understood however that other patterns of brick, stone or the like could be simulated by the grid as well by using other configurations of elongated members including curved elongated members instead of the straight members illustrated in FIG. 1. Elongated members 12, 14 form a mesh-like structure with the open areas 16 therebetween.

Figure 4:
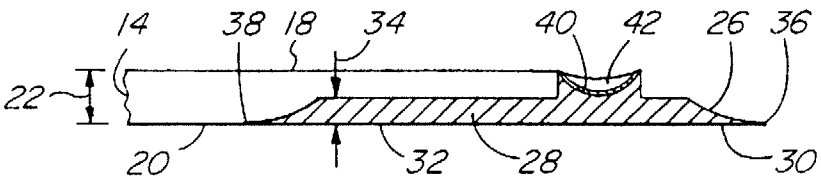
FIG. 4 is a sectional view taken along line 4—4 of FIG. 2.
Figure 2:
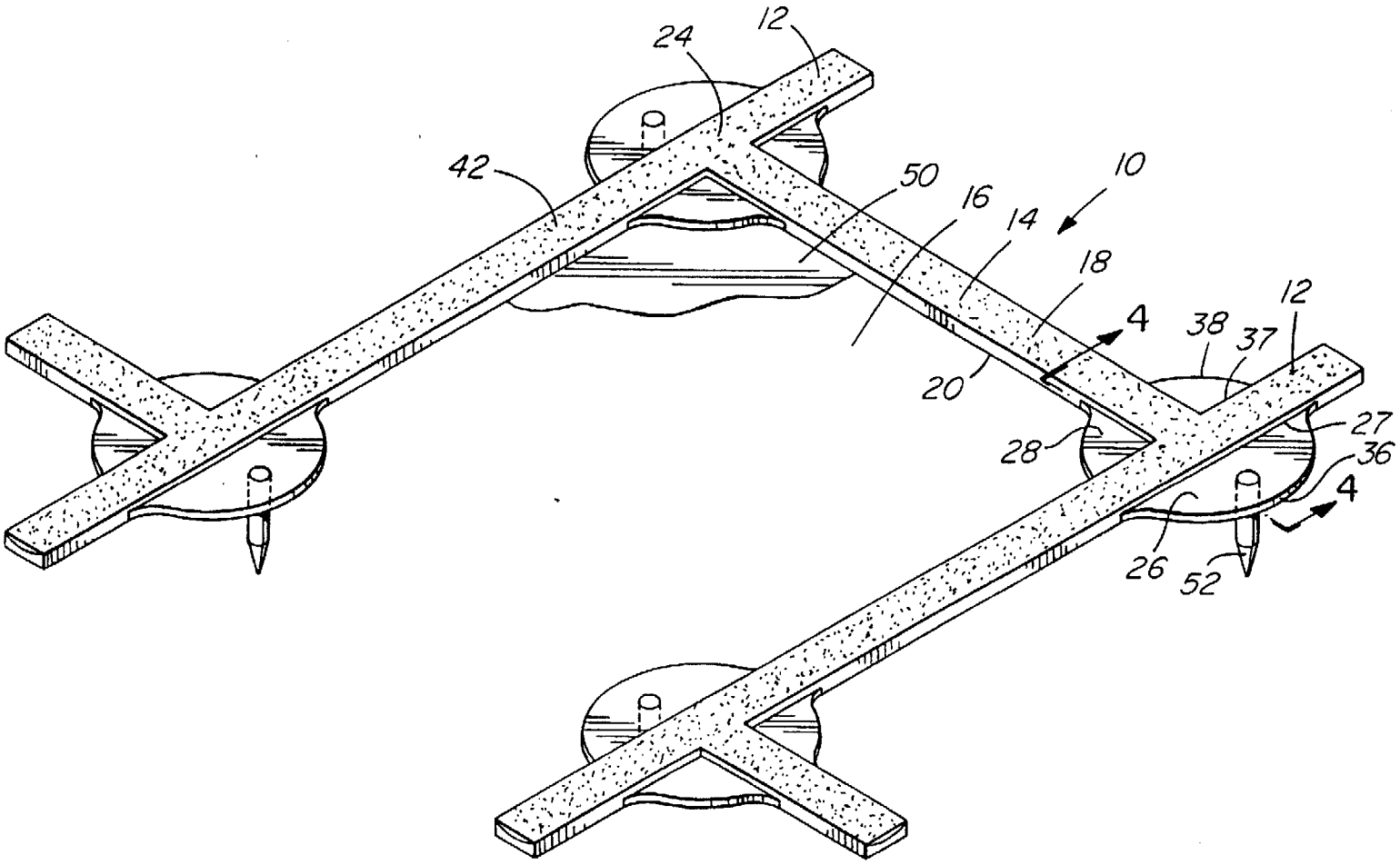
FIG. 2 is an enlarged, fragmentary isometric view thereof.

With reference to FIGS. 2 and 4, each of the elongated members 12 and 14 has a top 18, a bottom 20 and a thickness 22 extending therebetween as seen in FIG. 4. Elongated members 12, 14 are preferably 0.35 to 0.64 cm. in thickness. However, this is not critical.

The elongated members 12 and 14 may be connected together by a plurality of intersections 24. A plurality of connecting members 26 and 28 may be positioned at each inter-section 24. The connecting members 26 are semi-circular while the members 28 are quarter-circular. However they may be other shapes as well.

Two members 28 and one member 26 form a disc-like flange at each complete intersection. Inner edges 27 and 37 of the members 26 and 28 are connected to at least one elongated member while edges 36 and 38 are convexly curved. The members 26 and 28 have bottoms 30 and 32 respectively which are flush with the bottoms 20 of the members 12 and 14 as seen in FIG. 4. However, the connecting members 26 and 28 have a thickness 34 substantially less than the thickness 22 of the members 12 and 14. In the illustrated embodiment the thickness 34 of the connecting members 26 and 28 is one half the thickness 22 of the elongated members 12 and 14.

In one embodiment the outer edges 36 and 38 of the connecting members are tapered as seen in FIG. 4, which helps to hide the outer edges of the connecting members when the grid is used as described. The preferred material for the grid is concrete with a polymer additive. This provides compatibility with the liquid coating applied in the areas 16 as described below. The coating applied in areas 16 and the grid therefore have similar properties such as thermal expansion to ensure a durable long life for the finished surface. The grid can be made from a mixture of silica sand, cement powder and polymer with added fibres and/or other improved wear materials.

The function of connecting members 26, 28 is to strengthen the corners of grid 10 where elongated members 12, 14 intersect and to provide a narrow bearing flange against which the concrete acts to maintain grid 10 securely in place on surface 50. As discussed further below, connecting members 26, 28 also act as a surface for manually securing grid 10 to the underlying surface 50 with fasteners 52 (FIG. 2). In alternative embodiments of the invention, connecting members 26, 28, or similar narrow flanges extending into open areas 16, could be located anywhere along the length of elongated members 12, 14 and not necessarily at intersections 24. In a further alternative embodiment, connecting members 26, 28 could be omitted entirely and the edges of elongated members 12, 14 could be outwardly inclined to act as bearing surfaces against which the weight of the concrete could act to maintain grid 10 in position. These alternative embodiments would be suitable if grid 10 is constructed from a material not requiring reinforcement at intersections 24 in order to confer sufficient structural strength.

As seen in FIG. 4, each of the elongated members 12 and 14 has a transversely concave top 40 which initially is covered by a removable layer 42. The removable layer 42 could consist of various materials including wax (such as candle wax or bees wax), molded plastic (such as polyethylene or polypropylene), or peel-off tape. Removable layer 42 may also consist of suitable water-soluble coatings.

Removable layer 42 may be formed in a first mold having a concave bottom and a grid-like shape. The removable layer 42 is then removed from the first mold, inverted and placed in a second grid shaped mold having a flat bottom. The polymer enhanced concrete, or other material forming the permanent portion of grid 10, is poured on top of the curved surface of removable layer 42 and is allowed to set within the second mold. The grid is then removed from the second mold so that removable layer 42 faces upwards as shown in FIG. 2.

Alternatively, after removable layer 42 is formed in the first mold, an adhesive may be applied to its curved surface. A thin layer of fibre may then be applied to the curved surface such as by blowing fibre particles onto the adhesive coating. The removable layer is then dipped in a tray of cementitious material such as polymer enhanced concrete which is allowed to set to form grid members 12, 14. This step could be performed on site or at the factory. The layer of fibre provides a surface for the cementitious material to bond to and also provides grid 10 with enhanced structural strength and wearability.

In the alternative embodiment described above the application of fibre to removable layer 42 prior to dipping is optional. Layer 42 could be dipped directly into cementitious material of an appropriate consistency, either once or multiple times. After the dipping step, removable layer 42 may be set on a flat sheet of material to allow the cementitious material to set to the desired shape.

Method

In use, the grid 10 is applied over a surface 50 where a brick-like or stone-like pattern is desired. The grid could be secured to the surface by an adhesive, such as some of the prior art grids, but no such adhesive is used in this example. This allows the grid to be moved about and positioned adjacent other similar such grids to achieve the desired effect. Once the grid is in the proper place, it is secured by fasteners 52 shown in FIG. 2. Various types of fasteners could be used, such as screws, nails or staples, but in this example lead or plastic plugs are preferred.

A concrete drill is used to drill through the connecting members 26 or 28 and into the surface to a depth of approximately 1 cm. The lead or plastic plugs are then inserted through the connecting members and hammered into place there. It should be noted that these plugs are only required on low spots or dips in the surface. They hold the grid against the surface despite irregularities therein. If the surface is perfectly flat and generally horizontal then the grid may be held in place only by the liquid coating as described below. On the other hand, an adhesive or fasteners are essential when a vertical surface, such as a wall, is to be coated.

Alternatively, the existing surface may first be prepped with a thin layer of the polymer concrete before applying the grid. This may be applied with a squeegee, doing a small portion at a time. The grid is applied while the coating is still damp, thus avoiding voids or air pockets under the grid. The coating acts as an adhesive so fasteners are not required. The remaining liquid coating is applied after the grid is positioned. The coating goes over the connecting members 26, 28 and dries there permanently, thus further securing the grid in place.

Figure 3:
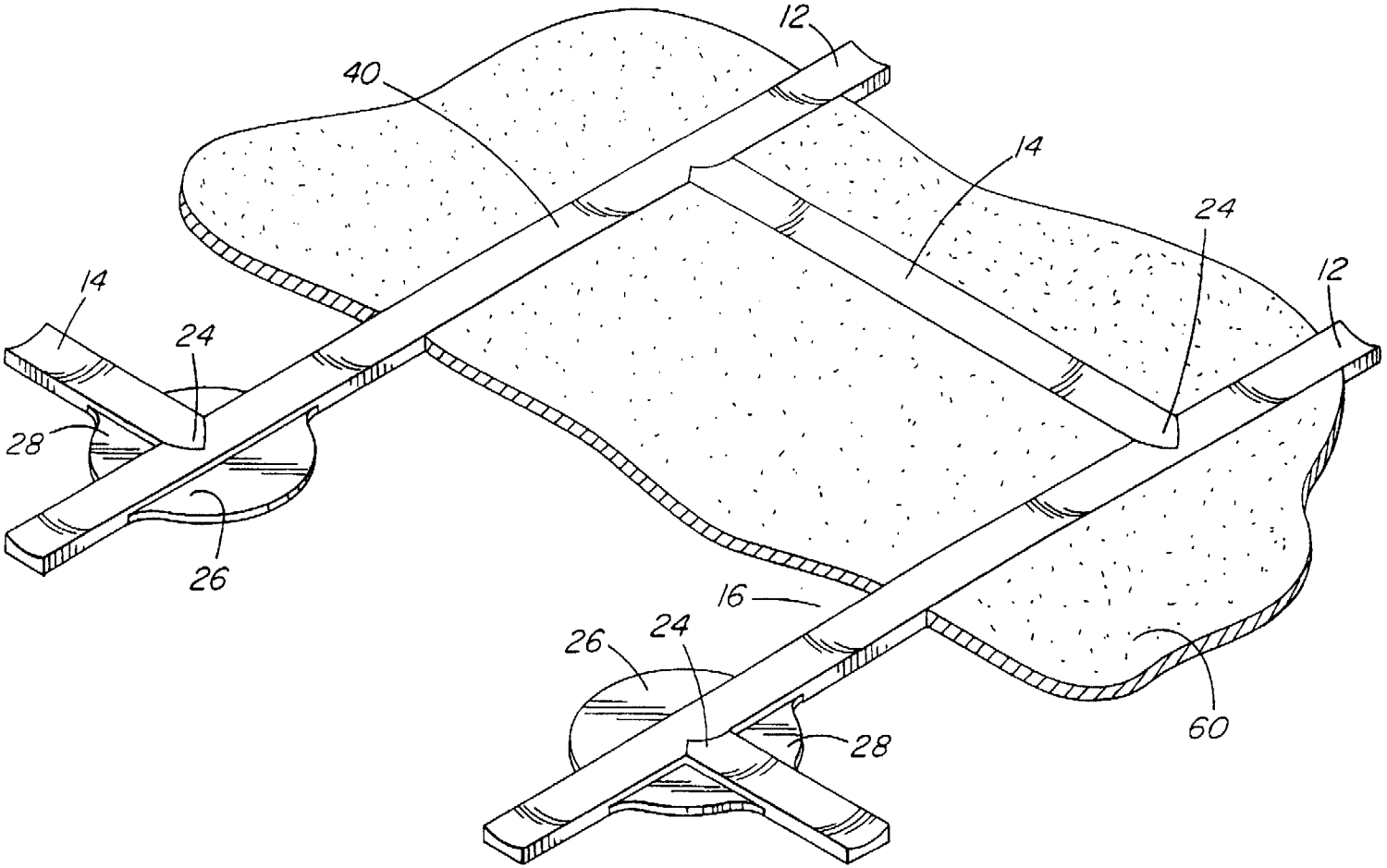
FIG. 3 is a view similar to FIG. 2 showing a grid after a liquid coating has been applied therebetween.

Once the grid is in place a liquid coating 60, as shown in FIG. 3 is applied to the areas 16 between the elongated members 12 and 14. Such liquid coatings are known and commercially available and are made of concrete with a polymer additive and a coloring agent added thereto. A typical formulation is 1 part portland cement, 2 parts silica sand, 1 part polymer, 2 parts water and coloring as required. The polymer in this example is available from Concrete Solutions, 6160 Fairmount Avenue, P.O. Box 600526, San Diego, Calif. 92160 although other polymers may be substituted. The coating can be smoothed flush with the tops of the members 12 and 14 using a suitable tool such as a squeegee.

After the coating has been applied, it is allowed to set to produce a waterproof surface. The next step is to remove layer 42 from the tops of the members 12 and 14. If removable layer 42 comprises wax or a water-soluble coating, layer 42 could be removed by pressure-washing to reveal elongated members 12, 14. Alternatively, if layer 42 comprises molded plastic or tape, layer 42 could be manually peeled off. The removable of layer 42 exposes the concave tops 40 of the members 12 and 14 which yields a mortar-like appearance (FIG. 3). The members 12 and 14 typically have a suitable contrasting color compared to the coating 60, thus giving a brick-like or stone-like appearance when the process is completed. The mortar-like appearance of the members 12 and 14 is enhanced by their concave tops 40, an effect not achieved by prior art devices and methods.

Alternatives and Variations

The grid may be made of other materials besides the polymer enhanced concrete. Epoxy has been found suitable, for example G-2 epoxy available from Industrial Formulators of Canada, Ltd., 3824 William Street, Burnaby, Canada V5C 3H9. A fill of glass fibre and silica sand is mixed with the liquid epoxy and poured cold into a mold. Another option is plastic materials, such as injected molded plastic.

Figure 5:
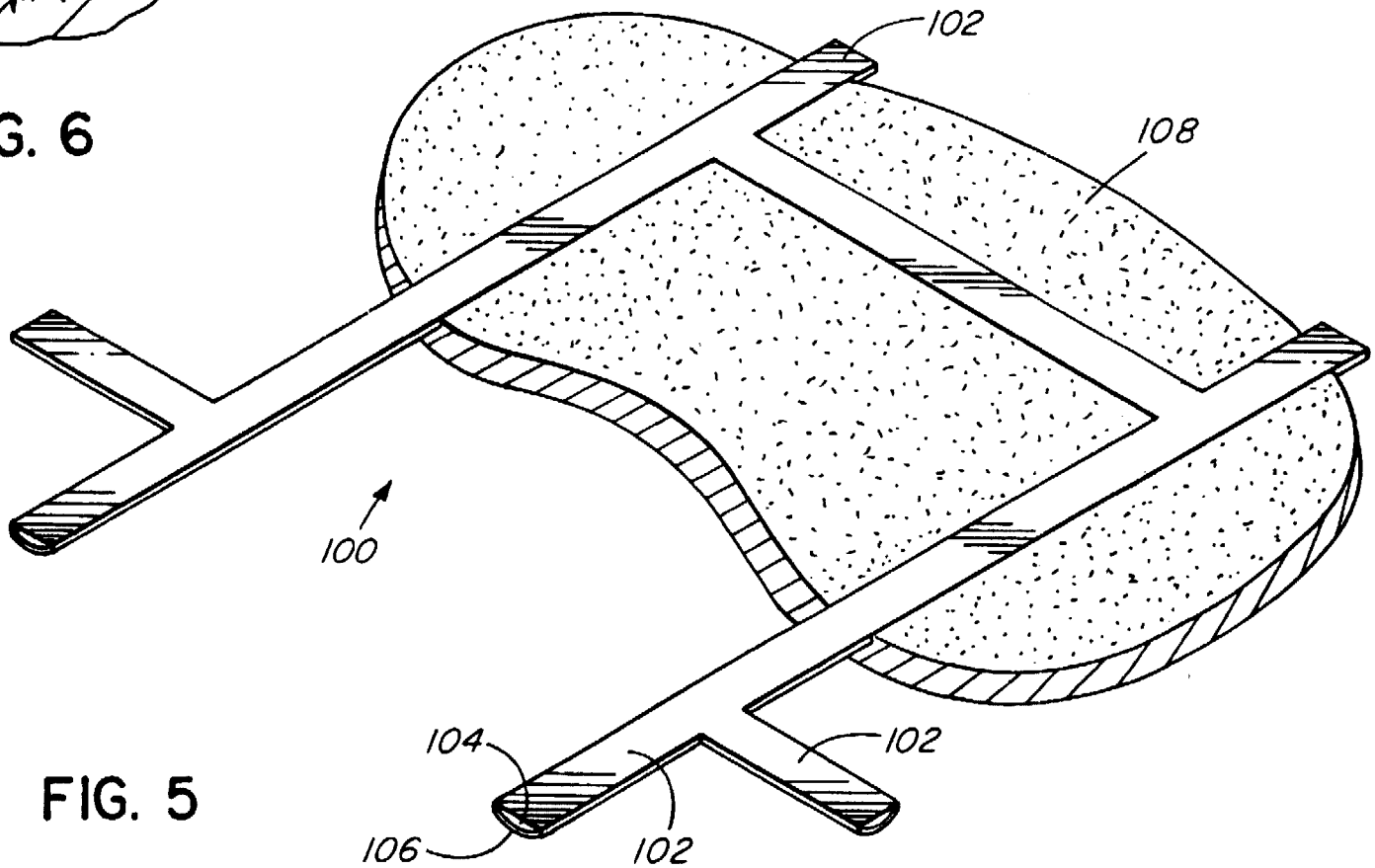
FIG. 5 is an enlarged, fragmentary isometric view of an alternative grid template having a convex bottom surface.

FIG. 5 illustrates an alternative embodiment of the invention comprising a template 100 having a plurality of elongated members 102 arranged in a grid. Each elongated member 102 has removable layer 104 and a thin mortar layer 106 having a convex lower surface. Removable layer 104 may be formed, for example, from extruded plastic. Mortar layer 106 preferably comprises a thin layer of grout material (preferably 10–20 mils in thickness) which is applied to removable layer 104 by any suitable means, such as by spray, roller, dip or casting. Template 100 is similar in structure to the grid 10 of FIG. 3 except that the bottom surface of elongated members 102 is curved rather than flat and no connecting members 26, 28 are used to anchor template 100 in place.

In use, the substrate to be treated is first primed with a thin layer of polymer enhanced concrete or a similar adhesive coating. Template 100 is then placed on the substrate at the desired location while the primer coat is still damp or tacky. The primer coat acts as an adhesive to maintain template 100 in place. As shown in FIG. 5, the primary liquid coating or filler material 108 is then spread on the substrate in the open areas between elongated members 102. Coating 108 also flows underneath and bonds to the curved bottom surface of mortar layer 106. The upper surface of coating 108 is levelled flush with the upper surface of removable layer 104 using a suitable tool such as a squeegee. A thin layer of coating 108 may entirely cover removable layer 104 after this levelling step has been completed.

After coating 108 is allowed to substantially set, removable layer 104 (and any thin layer of coating 108 thereon) is peeled away to expose the upper, concave surface of mortar layer 106. Thus mortar layer 106 remains set in place as in the original embodiment of the invention illustrated in FIG. 3. Preferably at least the exposed surface of mortar layer 106 and coating 108 have contrasting colors to simulate a brick and mortar effect.

When template 100 is manufactured, the upper, concave surface of mortar layer 106 is preferably coated with a release agent to facilitate the removal of layer 104. Alternatively, removable layer 104 and/or mortar layer 106 may be impregnated with suitable release agent(s). This is of importance to ensure that the bond between mortar layer 106 and coating 108 is not disrupted when removable layer 104 is manually peeled away. Preferably mortar layer 106 and coating 108 are both formed from the same material, such as polymer enhanced concrete, so that they will readily bond together and have the same coefficient of thermal expansion.

In an alternative embodiment of the applicant's method, coating 108 may first be spread on the substrate in question and levelled to the desired depth. Template 100 may then be pressed into coating 108. When this procedure is employed, template 100 will displace a portion of coating 108 directly underneath the template to form a series of depressions. After coating 108 has substantially set, removable layer 104 is peeled away as described above to expose mortar layer 106 which remains set in place. Depending upon the depth of coating 108, a thin layer of coating 108 may remain between the lowermost surface of mortar layer 106 and the underlying substrate.

Figure 6:
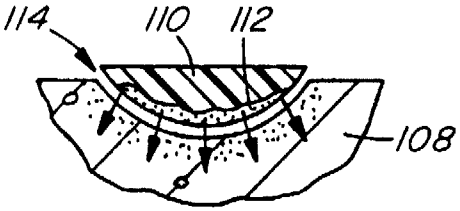
FIG. 6 is an enlarged, fragmentary sectional view of an alternative grid template comprising a dispersible pigment.

FIG. 6 illustrates a further alternative embodiment of the invention wherein an imprinting template is formed from a plurality of elongated members 110, each having a convex lower surface coated or impregnated with a dispersible pigment 112. Elongated members 110 are pressed into coating 108 while it is still in a plastic state to form a plurality of cylindrically concave depressions 114. Elongated members 110 are left in place for several hours while coating 108 is allowed to set (the time period will vary depending upon the type of coating and ambient conditions). During this interval, pigment 112 leeches into coating 108 as represented by the arrows in FIG. 6 to colorize the upper concave surface of depressions 114, thereby simulating a mortar line or grout line. Preferably pigment 112 is formulated to disperse a distance of approximately 10–20 mm. As shown in FIG. 6, not all of the convex lower surface of elongated members 110 is impregnated with pigment 112; this ensures that the pigment will not disperse laterally into coating 108 outside of the boundaries of the desired mortar line. Preferably pigment 112 is formulated so that it will leech from elongated members 110 only upon coming into contact with coating 108.

After coating 108 has substantially set, the entire template is then removed to expose the colorized depressions 114. Accordingly, in this embodiment of the invention no portion of elongated members 110 remains permanently set in coating 108 (apart from the dispersible pigment 112 referred to above). The lower convex surface of elongated members 110 may be textured to give depressions 114 the appearance of an authentic mortar line. As in the other embodiment described above, elongated members 110 may be coated or impregnated with a release agent to facilitate their removal from depressions 114 after coating 108 has set or substantially set.

Figure 7:
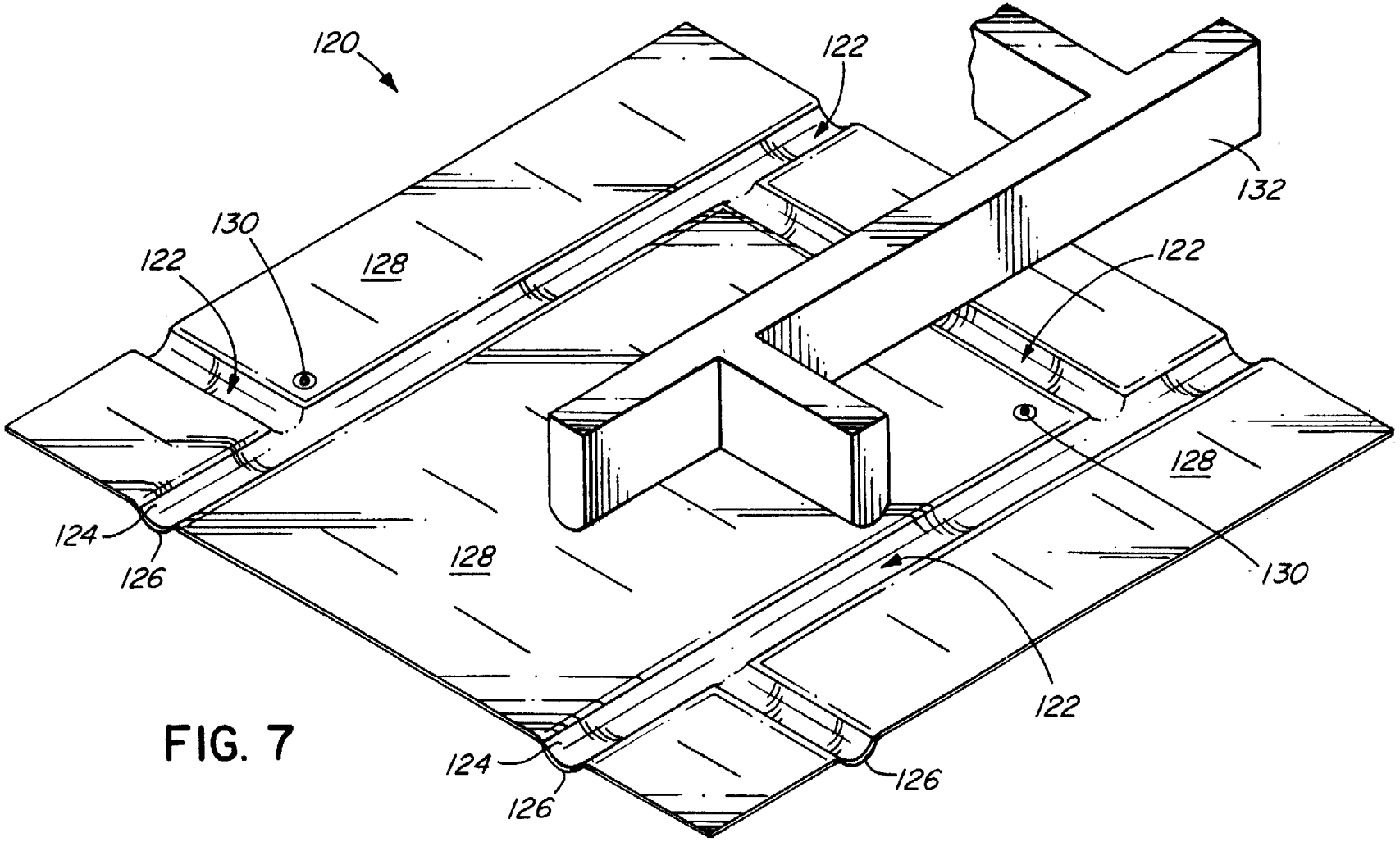
FIG. 7 is an enlarged, fragmentary isometric view of an alternative template and pressing tool.

FIG. 7 illustrates a further alternative embodiment of the invention wherein a template 120 comprises a plurality of elongated members 122 having cylindrically concave upper surfaces 124. The corresponding lower surfaces 126 of elongated members 122 are cylindrically convex and may be coated with a thin layer of grout material or a dispersible pigment as described in the FIG. 5 and 6 embodiments described above.

In the FIG. 7 embodiment, a plurality of thin sheets 128 extend between elongated members 122. Preferably sheets 128 are detachably secured to elongated members 122 so that they may be easily peeled away from the remainder of template 120. Each sheet 128 may comprise a thermoformed plastic panel having small slits (not shown) to permit passage of air through template 120. One or more vacumn holes 130 may also optionally be formed in each sheet 128 to enable an operator to conveniently withdraw any excess air trapped below template 120.

In use, a coating may first be spread on the substrate in question and levelled to the desired depth as described above. The template 120 of FIG. 7 may then be pressed into the coating while it is still in a plastic state. A tool 132 may be used to help uniformly impress template 120 into the underlying coating. Tool 132 preferably includes cylindrically convex lower surfaces which are readily alignable with the concave upper surfaces 124 of elongated members 122. Each tool 132 preferably covers an area of approximately 4–6 simulated bricks for optimum ease of use, although this is not critical. Tool 132 may include a vibrator to impart a vibratory motion to elongated members 122 to gently displace the underlying coating, thereby avoiding the formation of raised ridges adjacent to elongated members 122. Any pockets of air trapped underneath template 120 may be withdrawn through vacumn holes 130 or slits formed in sheets 128 as discussed above.

If the convex lower surface 126 of elongated members 122 comprises a thin layer of grout as in the FIG. 5 embodiment, then template 120 is left in place long enough for surface 126 to bond securely to the coating spread over the substrate. The upper surfaces 124 of elongated members 122 are then peeled away to expose the underlying layer of grout which remains set in place, forming the simulated mortar line. Sheets 128 are also peeled away to expose the coating in the areas between elongate members 122.

If the convex lower surface 126 of elongated members 122 comprises a layer of dispersible pigment as in the FIG. 6 embodiment, then template 120 is left in place long enough for the pigment to migrate into the underlying coating to form a simulated mortar line as discussed above. In this embodiment, the entire template 120 is then removed and no portion of the template structure remains set in place (apart from the dispersible pigment). The undersurface of sheets 128 may also be coated or impregnated with a dispersible coating, preferably contrasting in color to the pigment applied to lower surface 126. In this manner the simulated brick and mortar portions of the coating will ultimately have contrasting colors, even if an unpigmented coating is used as the filler material.

Further, the lower surface 126 of elongated members 122 and/or the undersurface of sheets 128 may be textured to leave an impression in the underlying coating. Such textured surfaces may be used, for example, to impart an "antique" or cobblestone look to the simulated brick or tile surface.

In applications where it is not necessary to colorize or texture the coating in the areas between the elongated members 122, sheets 128 may be detached from template 120 prior to use. Sheets 128 must also be detached in those cases where template 120 is positioned on the substrate in question before the liquid coating filler is poured. This, of course, permits the liquid coating to be spread between the elongate members 122 as in the FIGS. 3 and 5 embodiments described above which also employ an "open web" template design. Preferably the joinder between elongate members 122 and sheets 128 would be scored or otherwise tooled to ensure sheets 128 are readily detachable.

Figure 8:
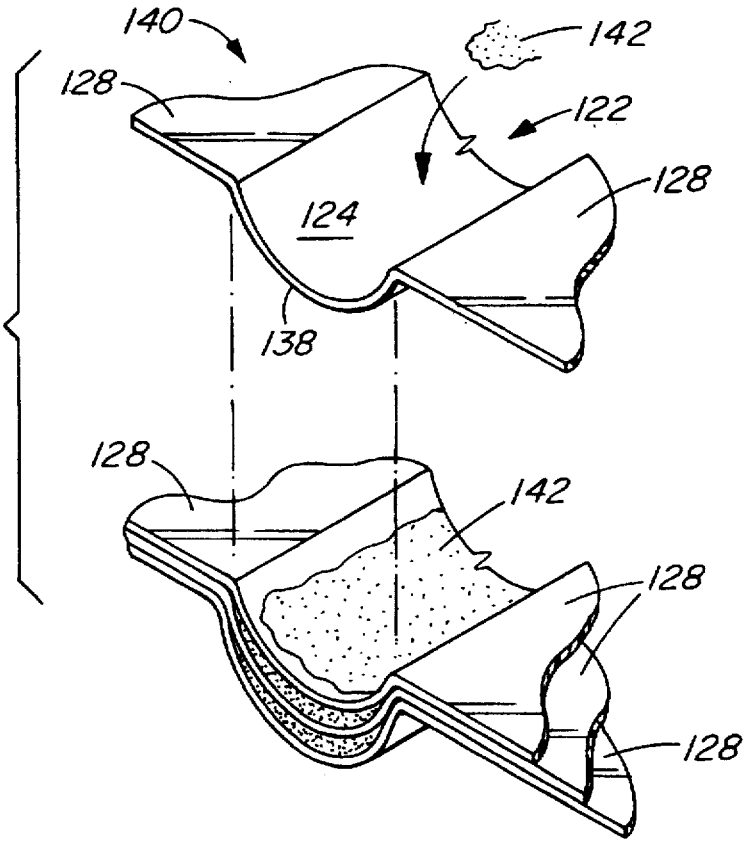
FIG. 8 is an enlarged, fragmentary, exploded isometric view illustrating a process for forming the template of FIG. 7.

FIG. 8 illustrates a process for forming a plurality of stackable templates 120 as illustrated in FIG. 7. More particularly, each template 120 comprises elongate members 122, each having a cylindrically concave removable upper surface 124 and a corresponding lower surface 126 comprising a thin layer of grout. As shown in FIG. 8, each template 120 essentially constitutes a mold for casting the surface 126 of the next-in-sequence template 120.

The first step in the FIG. 8 process is to provide a partial template profile 140 comprising elongated members 122 and sheets 128. Each elongated member 122 of profile 140 includes cylindrically concave upper surface 124 defining an elongated channel and a corresponding convex lower surface 138. Profile 140 is preferably constructed from thermoformed plastic, preferably 10–20 mils in thickness, having sufficient rigidity to hold its shape.

Figure 9:
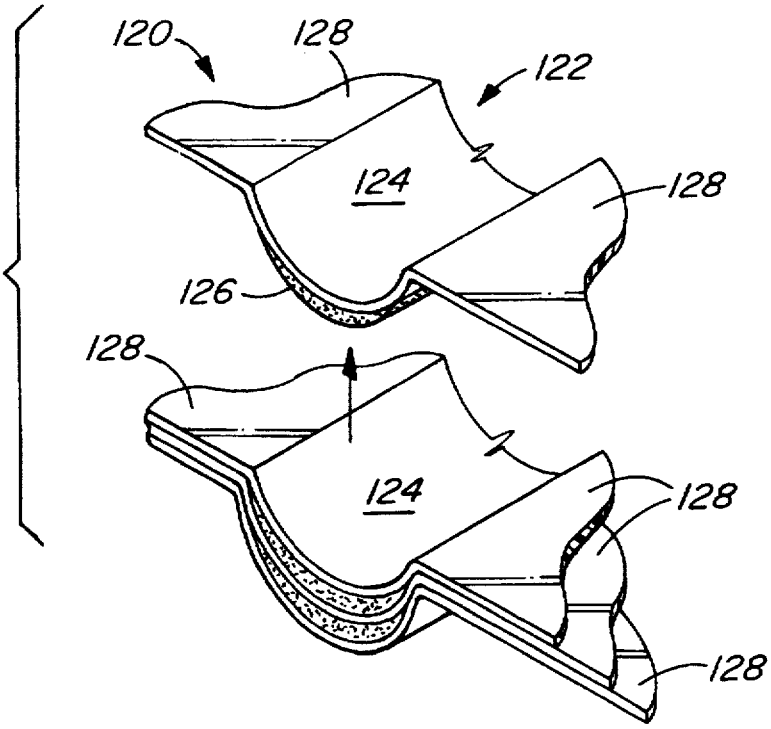
FIG. 9 is an enlarged, fragmentary, exploded isometric view illustrating one template being removed from a stack of templates formed according to the manufacturing process of FIG. 8.

The next step in the manufacturing process is to introduce a supply of grout material 142 into the channel defined by the elongated member upper surface 124. A next-in-sequence profile 140 is then pressed onto the first profile 140 so that the respective elongated members 122 are aligned. As shown in FIG. 8, this causes the grout material held in the first profile 140 to conform to the convex shape of the lower surface 138 of the next-in-sequence profile 140. The grout material is allowed to set for a time period sufficient to create a secure bond between grout 142 and surface 138, thereby forming the lower surface 126 of a completed template 120 (FIG. 9). The process is repeated to produce a stack of templates 120 suitable for shipping.

As shown in FIG. 9, at the job site the uppermost template 120 may be readily peeled away from the remainder of the stack for use in imprinting a coated substrate as described in detail above. Preferably upper surface 124 of each profile 140 is coated or impregnated with a release agent to facilitate separation of the templates 120 at the job site. Lower surface 138 may also be treated with a release agent to ensure that the upper layer of template 120 is readily removable from the lower layer (which remains set in place forming the mortar line).

As should be apparent to someone skilled in the art, the manufacturing process of FIG. 8 could be employed to form "open web" templates which do not include sheets 128. As discussed above, such open web templates would be suitable for use in applications where it is not necessary to texture or colorize the simulated bricks or tiles between elongated members 122. In this embodiment, a flat top panel (not shown) could be bonded to the upper edges of elongated members 122 to define a cavity between the top panel and the underlying cylindrically concave surface 124. In use, the open web template is first set in place and the liquid coating is smoothed flush with the top panel of the template. The top panel would prevent the coating from spilling into the channel defined by concave surface 124. The top panel, including any thin layer of coating thereon, could then be peeled away from the remainder of the template. After the coating has substantially set, surface 124 would also be removed as described above to expose surface 126, which remains set in place to form the simulated mortar line.

Figure 10:
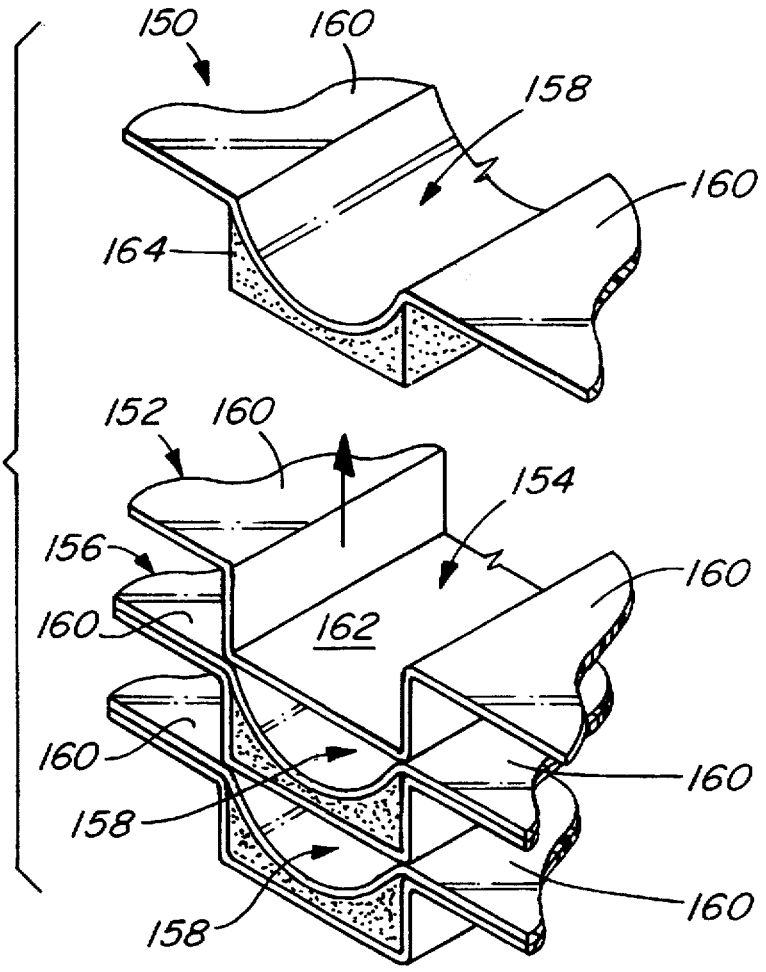
FIG. 10 is an enlarged, fragmentary, exploded isometric view illustrating a process for manufacturing and using a further alternative template having a flat bottom surface.

FIG. 10 illustrates a manufacturing process similar to the process of FIGS. 8 and 9 for forming a template 150 having a flat bottom surface (similar to the grid 10 of FIG. 3). In this embodiment a first template profile 152 having a rectangular depression 154 formed therein, and a second template profile 156 having a cylindrically concave depression 158 formed therein are provided. As in the previous embodiment, profiles 152, 154 are preferably thermoformed from plastic of sufficient rigidity to hold its shape.

The cementitious grout material is introduced into the rectangular depression 154 of the first profile 152 and the second profile 156 is then pressed into first profile 152 so that the grout material conforms to the convex lower surface of concave depression 158. The process is repeated so that a series of alternating first and second profiles are stacked one on top of each other as shown in FIG. 10. As in the FIG. 8 embodiment, each template 150 essentially constitutes a mold for casting the mortar line forming portion 164 of the next-in-sequence template 150.

At the job site, the uppermost cast template 150 may be readily peeled away from the remainder of the stack for use in imprinting a coated substrate in a manner similar to the embodiment of FIG. 9. As in the FIG. 9 embodiment, if an "open web" design is desired, sheets 160 are omitted and a top panel may be bonded to the upper edges of template 150 to prevent coating from spilling into depression 158 when template 150 is used. As should be apparent from FIG. 10, the lower surface 162 of a profile 152 could comprise the top panel of the next template 150 in the stack. Thus pairs of profiles 152 and 156 may be welded or otherwise secured together during the manufacturing process, enabling them to be removed from the stack together in one motion. For example, each pair of profiles 152, 156 could be welded together before they are impressed into the grout material introduced into a previous-in-sequence pair of profiles 152, 156.

Templates manufactured in accordance with the processes of FIGS. 8–10 may be mass-produced at a much lower cost than traditional cement imprinting tools. Moreover, since the templates are disposable, less release agents are required and less time is spent cleaning tools after each usage. This reduces the applicator's cost to imprint a given surface area of substrate in accordance with the invention.

As should be apparent to someone skilled in the art, the shape of the depressions in the plastic profiles used to form the imprinting templates could vary depending upon the shape of mortar line desired. It is not critical that the depressions be either rectangular or semi-circular in cross-section as illustrated in the embodiments of FIGS. 8–10. In some applications mortar lines having very shallow concave depressions, or no depressions at all, may be desired. For example, shallow mortar lines are preferred indoors for ease of cleaning.

It would be understood by someone skilled in the art that many of the details provided above are by way of example only and are not intended to limit the scope of the invention which is to be interpreted by reference to the following claims.

What is claimed:

1. A method of forming a pattern on a substrate comprising the steps of:

(b) providing a template having a mortar line forming portion and a removable portion;

(a) applying a settable liquid coating to said substrate;

(c) impressing said template into said coating;

(d) allowing said coating to substantially set; and (e) removing at least said removable portion of said template from said substrate.

2. The method as defined in claim 1, comprising the step of removing said mortar line forming portion from said substrate.

3. The method as defined in claim 2, wherein said mortar line forming portion of said template is convex and forms a concave depression in said coating.

4. The method as defined in claim 2, wherein said coating and said mortar line forming portion of said template have contrasting colors.

5. The method as defined in claim 2, wherein said mortar line forming portion comprises a pigment which disperses into said coating in the vicinity of said template as said coating is allowed to set.

6. The method as defined in claim 5, wherein said coating and said pigment have contrasting colors.

7. The method as defined in claim 1, wherein said template comprises a plurality of elongate members connected together to form a grid.

8. The method as defined in claim 7, wherein said template comprises sheet sections extending between said elongate members and detachably secured thereto.

9. The method as defined in claim 8, wherein said sheet sections have a pattern formed on a first surface thereof for imprinting said coating.

10. The method of claim 9, wherein said first surface of each of said sheet sections comprises a pigment which disperses into said coating as coating is allowed to set.

11. The method as defined in claim 9, wherein said sheet sections are air-permeable.

12. The method as defined in claim 9, wherein at least some of said sheet sections have air release holes formed therein to permit passage of air through said template.

13. The method as defined in claim 7, further comprising the step of placing a vibrating press on said elongate members to uniformly compress said template into said coating.

14. The method as defined in claim 10, wherein said pigment and said mortar line forming portion of said template have contrasting colors.

15. The method as defined in claim 8, further comprising the step of removing said sheet sections from said template to expose said coating between said elongate members.

16. A template for forming a pattern in a settable coating comprising:

(a) a plurality of elongate members connected together to form a grid, each of said elongate members comprising a mortar line forming portion and a removable portion; and (b) a plurality of sheets extending between said elongate members, wherein said sheets are detachably connected to said elongate members.

17. The template as defined in claim 16, wherein said mortar line forming portion has a convex outer surface for forming a concave impression in said settable coating.

18. The template as defined in claim 16, wherein said mortar line forming portion comprises a pigment which is dispersable into said settable coating.

19. The template as defined in claim 16, wherein said sheets comprise a pigment which is dispersible into said settable coating.

20. The template as defined in claim 16, wherein each of said sheets is formed from a thin layer of plastic.

21. A method of manufacturing a template for forming a pattern in a settable material, comprising the steps of:

(a) providing a first profile comprising a sheet having a first elongate depression formed therein;

(b) providing a second profile comprising a sheet having a second elongate depression formed therein, said second depression having a contoured surface;

(c) introducing a settable material into said first depression; and (d) pressing said first and second profiles together to form said template such that said first depression is inserted into said second depression causing said settable material to conform to said contoured surface.

22. A method of manufacturing a plurality of stackable templates, each template for forming a pattern in a settable material, said method comprising the steps of:

(a) providing a first profile comprising a sheet having a first elongate depression formed therein, said first depression having a convex outer surface and a concave inner surface;

(b) providing a second profile comprising a second sheet having a second elongate depression formed therein, said second depression having a flat inner surface;

(c) fastening said second profile to said first profile to form a first one of said templates, wherein said second depression is aligned above said first depression;

(d) introducing a settable material into said second depression;

(e) repeating steps (a)–(c) to form a further one of said templates;

(f) impressing said convex surface of said further one of said templates into said second depression of said first one of said templates, such that said settable material conforms to said convex surface;

(g) introducing said settable material into said second depression of said further one of said templates; and (h) repeating steps (e)–(g) until a sufficient number of said stackable templates are formed.

23. A method of producing a grid-like pattern on a surface, comprising:

placing on the surface a grid which includes a plurality of elongated members connected together at intersections and extending about a plurality of open areas, said grid having a non-removable body portion having a concave top surface; and a removable layer located on said top surface;

spreading a liquid coating over the surface in the open areas between the elongated members of the grid, such that said liquid coating does not cover said grid;

allowing the liquid coating to set; and removing the removable layer from-the grid, exposing said concave top surface;

wherein the coefficient of thermal expansion of said non-removable body portion is substantially similar to the coefficient of thermal expansion of said liquid coating.

24. A method of producing a grid-like pattern on a surface, comprising:

placing on the surface a grid which includes a plurality of elongated members connected together at intersections and extending about a plurality of open areas, said grid having a non-removable body portion having a concave top surface; and a removable layer located on said top surface;

spreading a liquid coating over the surface in the open areas between the elongated members of the grid, such that said liquid coating does not cover said grid;

allowing the liquid coating to set; and removing the removable layer from the grid, exposing said concave top surface;

wherein the thickness of said removable layer is less than the thickness of said non-removable body portion such that a relatively shallow cavity is exposed upon removal of said removable surface.

25. A grid for producing a pattern on a surface, said grid comprising:

(a) a plurality of elongated members connected at intersections and extending about a plurality of open areas to form a mesh-like structure, each of said elongate members having a non-removable body portion having a cylindrically concave top surface, a bottom surface and a thickness extending between said top and bottom surfaces;

(b) a removal layer on said concave top surface;

(c) wherein, said thickness of said non-removable body portion is greater than the thickness of said removable layer.

* * * * *